US005150508A

United States Patent [19]

St. Denis

[11] Patent Number: 5,150,508

[45] Date of Patent: Sep. 29, 1992

[54] HEMMING MACHINE AND METHOD

[75] Inventor: Lucen St. Denis, Windsor, Canada

[73] Assignee: E. R. St. Denis & Sons, Limited, Oldcastle, Canada

[21] Appl. No.: 723,383

[22] Filed: Jun. 28, 1991

[51] Int. Cl.[5] ..... B21D 39/02; B23P 11/00

[52] U.S. Cl. ..... 29/463; 29/511; 29/243.5

[58] Field of Search ..... 29/897.2, 463, 509, 29/510, 511, 513, 243.5

[56] References Cited

U.S. PATENT DOCUMENTS

| | | | |
|---|---|---|---|
| 3,598,073 | 8/1971 | St. Denis | 113/54 |
| 4,455,728 | 6/1984 | Hesse | 29/511 X |
| 4,891,964 | 1/1990 | Hallströn | 29/509 X |

FOREIGN PATENT DOCUMENTS

| | | | |
|---|---|---|---|
| 253484 | 9/1925 | Canada | 153/2 |
| 380047 | 3/1939 | Canada | 113/1 |
| 518248 | 11/1955 | Canada | 26/187 |
| 604357 | 8/1960 | Canada | 153/8 |
| 701558 | 1/1965 | Canada | 153/17 |
| 901784 | 6/1972 | Canada | 29/84.44 |
| 374568 | 2/1964 | Switzerland | 29/511 |

*Primary Examiner*—Timothy V. Eley

[57] ABSTRACT

This invention relates to a machine and a method for forming a unitary structure from a first steel panel having an upturned flange and a second steel panel having a flat edge portion. The machine is comprised of a support surface for receiving the two panels in a nested relation. The support surface, holding the nested panels, is moved to a pre-hem position. The support surface then presses the flange of the first panel against a pre-hem flange engaging member to bend the flange to approximately 45° with respect to the plane of the first panel. The support surface moves the nested panels to a final hem position. The support surface then presses the flange against a final hem engaging member to bend the flange into full engagement with the edge portion of the second panel to form a unitary structure.

13 Claims, 2 Drawing Sheets

HEMMING MACHINE AND METHOD

FIELD OF THE INVENTION

This invention relates to an improved hemming machine for joining two preformed metal panels. More particularly, this invention relates to a machine for constructing car doors.

BACKGROUND OF THE INVENTION

It is common practice, particularly in the automotive industry, to join together two metal preformed panels into a unitary hollow structural unit. A typical unit of this type is the hollow door used in passenger cars and light trucks. These doors customarily comprise an outer and inner metal sheet or panel.

The manner in which the two panels are joined is the subject of this invention. The process of joining or clinching the two panels together is referred to as hemming.

It is important that the hemming procedure results in a firm, vice like grip of the flange of the outer panel with the edge portion of the inner panel. It is also vital that the shape and dimensions of the door are held within prescribed tolerances.

PRIOR ART

Prior art hemming type machines as described in Canadian Pat. Nos. 253,484 issued on Sep. 8, 1925; 604,357 issued on Aug. 30, 1960 and 701,558 issued on Jan. 12, 1965, all join two pre-formed panels together by moving a die block over a right-angled flange of one panel. The panels remain in a generally fixed position while the die blocks clinch the flange of one panel over the edge of the other panel.

A widely used procedure for hemming door panels involves using two separate machines, one for pre-hemming and the other for the final hemming step. The disadvantages of this type of system include the need for two presses, which use a large amount of floor space, and the time and labour required to move the panels from one press to the other.

Several other advancements have been proposed that attempt to combine the operations of pre-hemming and final hemming into one machine. These machines move a die block to perform both the pre-hem and final hem procedure. The die block may be moved in a single stroke to force the flange of one panel to clinch over the edge of the other panel as disclosed in Canadian Pat. No. 253,484. Canadian Pat. No. 701,558 discloses a method in which the die block is slightly rotated to fully bend the flange of one panel into full engagement with the edge of the other panel.

The disadvantages of these "one-step" machines involve the requirement to accurately index the position of the die block and since only one die block is used the flanged edge of one of the panels tends to be rolled. This rolled edge can cause the door to shrink, which greatly effects the dimensional consistency in the finished product.

The various forms of machines discussed are generally unsatisfactory because the hemming procedure does not provide a sufficiently firm bond, and the door dimensions are not kept within the prescribed tolerances.

SUMMARY OF THE INVENTION

An object of the present invention is to provide a single machine capable of bending a right-angled flange, located around the edge of an outer panel, to approximately 45° around the edge portion of an inner panel, and then, using another die block, to fully engage the flange of the outer panel with the edge portion of the inner panel. The pre-hemming process is carried out at a pre-hem position using a pre-hem die block. The final hemming process is carried out at a final hem position using a final hem die block.

Another object of the present invention is to provide a hemming machine that can be quickly retro-fitted to accept new door shapes by changing the die blocks.

Another object of the present invention is to provide a mechanism, integral with the machine, that will pre-hem the corners where two right-angled flanges meet. This will reduce the occurrence of the corner seam buckling when the two coincident edges are hemmed.

To reduce the problems (e.g. shrinking and rolling) related to forming a door structure from two panels, the present invention moves the pair of nested panels against stationary die blocks located at a pre-hem and final hem position. The first bending action (pre-hem) occurs at the pre-hem position and the second bending action (final hem) occurs at the final hem position.

In accordance with an aspect of this invention there is provided a machine for forming a unitary structure from a first steel panel having an upturned flange and a second steel panel having a flat edge portion, comprising:

(a) a support surface unit including a support surface for receiving said first panel and said second panel in a superimposed relation with said edge portion of said second panel proximate to said flange of said first panel;

(b) a plurality of first flange engaging members having bevelled engaging surfaces, said first flange engaging members being located at a pre-hem position;

(c) a plurality of second flange engaging members having substantially right-angled engaging surfaces, said second flange engaging members being located at a final-hem position;

(d) means for moving said support surface unit to said pre-hem position such that said flange of said first panel is pressed against said bevelled engaging surfaces of said first flange engaging members, wherein said flange of said first panel is bent by approximately 45° with respect to the plane of said first panel to form a pre-hemmed flange;

(e) means for moving said support surface to said final hem position such that said pre-hemmed flange is pressed against said substantially right-angled engaging surfaces of said second flange engaging members, wherein said pre-hemmed flange of said first panel is bent to fully clinch said edge portion of said second panel to form said unitary structure.

In accordance with another aspect of this invention there is provided a method for forming a unitary structure from a first steel panel with an upturned flange and a second steel panel with a flat edge portion, comprising:

(a) placing said second panel in a superimposed relation to said first panel on a support surface, said edge portion of said second panel being proximate to said flange of said first panel;

(b) pressing said flange of said first panel against a plurality of first flange engaging members so that said flange is bent to approximately 45° with respect to the plane of said first panel to produce a pre-hemmed flange;

(c) pressing said pre-hemmed flange of said first panel against a plurality of second flange engaging members so that said flange is fully engaged against said edge portion of said second panel to form said unitary structure.

BRIEF DESCRIPTION OF THE DRAWINGS

In the drawings, wherein like numerals of reference indicate corresponding parts in the various Figures in which.

DESCRIPTION OF A PREFERRED EMBODIMENT

Figure 1:
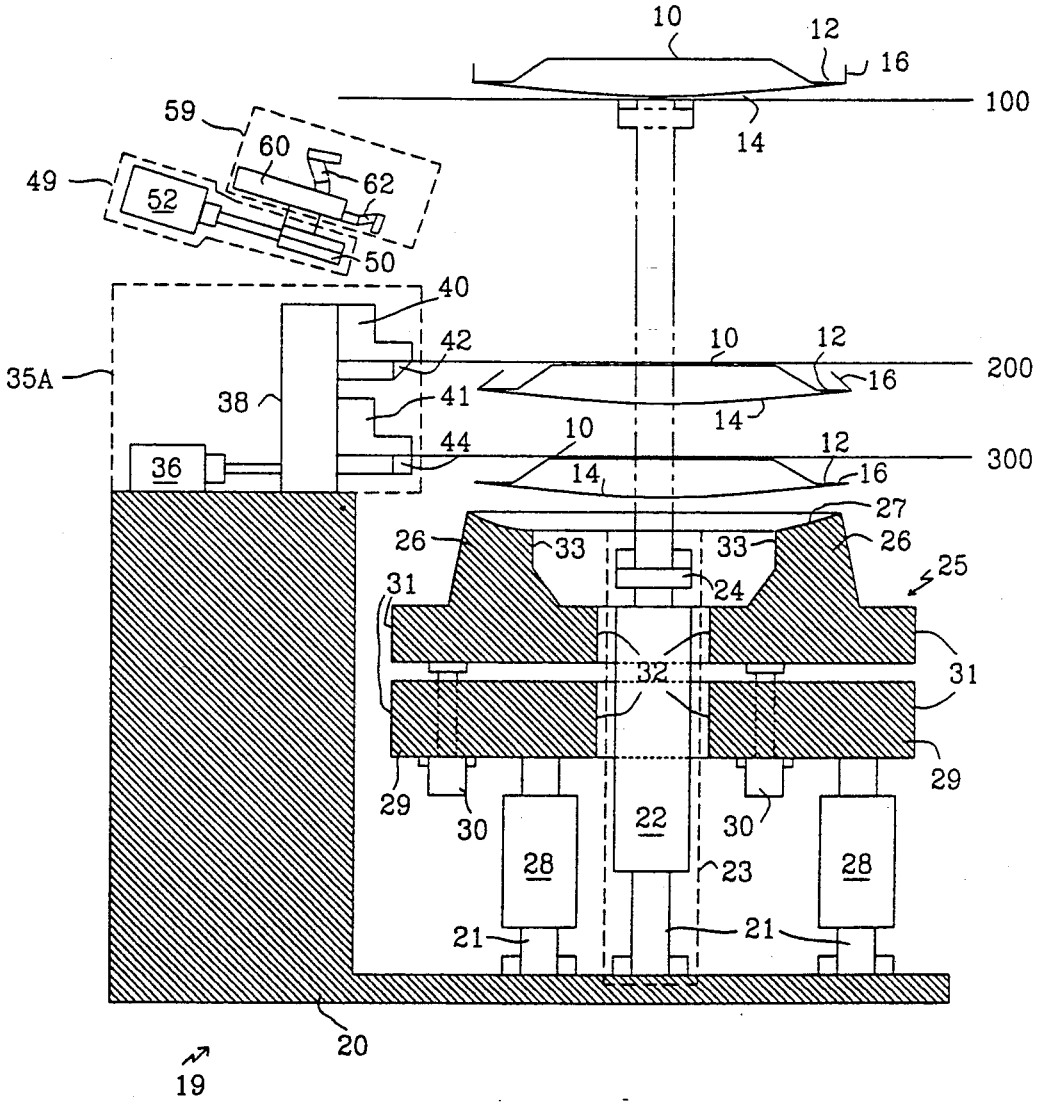
FIG. 1 is a schematic side sectional elevational view of one embodiment of the present invention.

Referring to FIG. 1, the workpieces of this invention consist of an inner panel 10 and an outer panel 14. A securing flange 16 is located substantially around the peripheral edge of outer panel 14. The flange 16 is approximately perpendicular to the general plane of panel 14. The inner panel 10 is formed with an edge portion 12. In practice, the panels are not planar, but are curved both longitudinally and transversely to conform to the shape of the side of the vehicle.

If the door to be manufactured has a frame around the window then flange 16 will be located along all four sides. However, some car doors do not have a frame around the window and as a result the window side does not require flange 16.

Figure 2:
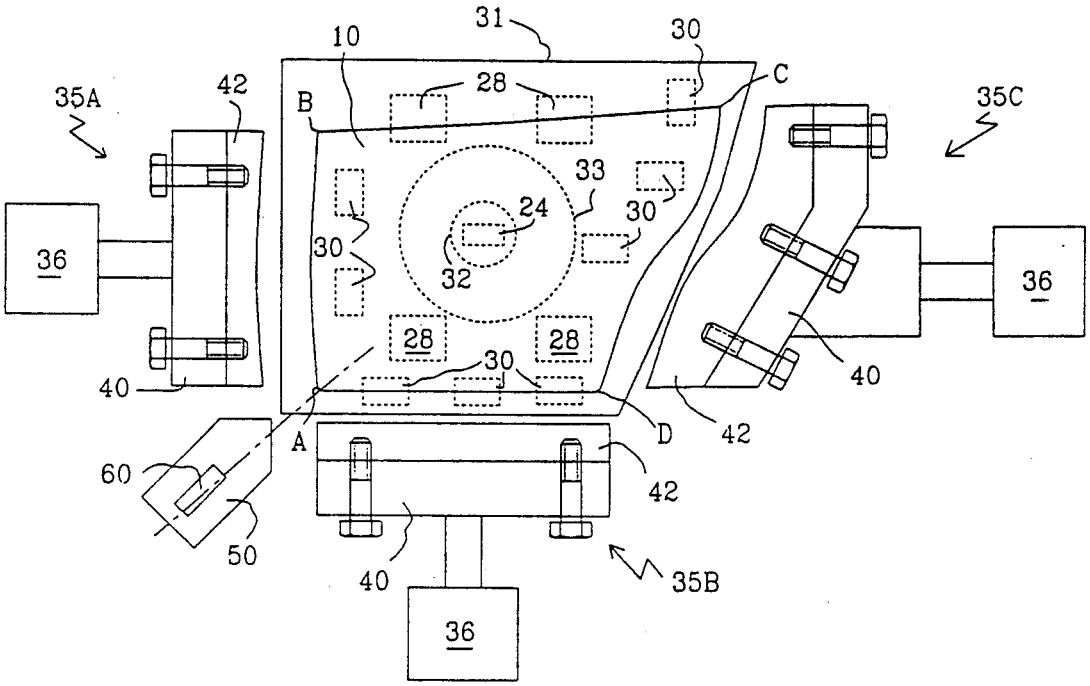
FIG. 2 is a plan view of the embodiment illustrate in FIG. 1.

Panels 10 and 14, which will eventually form a unitary structure, are shown for a rear door assembly. FIG. 2 provides a plan view of inner panel 10. The four corners of panels 10 and 14 are labelled as A, B, C and D.

A hemming machine 19 consists of a panel lifting system 23, a panel support and press system 25, a plurality of hemming units 35A, 35B and 35C, a corner pre-hem unit 49, a corner clamp unit 59 and a control unit (not shown in the drawings). Each one of these main components will be described in detail in conjunction with FIGS. 1 to 4.

The panel lift system 23 comprises a transfer cradle 24 that is mounted on a transfer cylinder 22 connected to a frame 20 by a cylinder support 21. Panels 10 and 14 are placed on cradle 24 with cylinder 22 being used to raise and lower panels 10 and 14 from a transfer position 100 to a pre-hem position 200. Lift system 23 is shown in FIG. 1 in the lowered position. The phantom lines illustrate lift system 23 in a raised position at transfer position 100.

The panel support and press system 25 comprises a panel support nest 26, a support base 29 and a plurality of lift cylinders 28 and press cylinders 30. In this embodiment cylinders 28 and 30 are hydraulic. However, virtually any type of lifting mechanism can be used. Lift cylinders 28 are used in the lifting process, and therefore are long stroke (small diameter) cylinders. Press cylinders 30 are used to bend flange 16, and therefore are short stroke (large diameter) cylinders. The nest 26 and base 29 have a hollow portion in the centre that permits panel lift system 23 to operate within nest 26 and base 29. The nest 26 and base 29 have an outer edge 31 and an inner edge 32.

The hemming operation occurs when the nested panels 10 and 14 are placed on panel support nest 26. A top surface 27 of nest 26 is shaped to conform with the contour of panel 14. The top surface 27 of nest 26 has an inner edge 33.

Support nest 26 is linked to base 29 by the shaft portions of press cylinders 30, which are connected to the underside of base 29. When press cylinders 30 are actuated nest 26 moves upwardly by approximately 2.5 cm while base 29 remains in a locked position by lift cylinders 28. Nest 26 and base 29 are raised and lowered by lift cylinders 28 connected between base 29 and frame 20 by cylinder supports 21.

Since base 29 is rigid, cylinders 28 can be located in virtually any configuration under base 29. One possible configuration of lift cylinders 28 is illustrated in the plan view of FIG. 2. Two cylinders 28 are located between corners A and D. Two other cylinders 28 are located between corners B and C. The location of lift cylinders 28 should provide a uniform support and lifting force for base 29 and nest 26.

The shorter stroke press cylinders 30 are connected under base 29 with the shaft of cylinder 30 extending to the bottom of nest 26 and are primarily located around the edge of base 29. Cylinders 30 are used to provide the necessary force to push panels 10 and 14 against die blocks 42 and 44 to bend flange 16 over edge 12. One possible configuration for press cylinders 30 is illustrated in FIG. 2. The location of press cylinders 30 should provide a uniform bending force around the edge of the door panels. The cylinders should uniformly bend flange 16 over edge 12 along all three sides of panels 10 and 14.

The support and press system 25 is shown in the lowered resting position below a final hem position 300.

Hemming units 35A–C are attached to frame 20 above the resting position of lifting system 23 and support system 25. A plurality of hemming units 35A–C are illustrated in the plan view of FIG. 2. One hemming unit is located along each edge of the door that requires hemming. In this embodiment three hemming units 35A, 35B, and 35C are shown.

A first hemming unit 35A is located along the hinge side between corners A and B. A second hemming unit 35B is located along the bottom of the door between corners A and D. A third hemming unit 35C is located along the handle side between corners C and D. However, depending on the type of door a fourth hemming unit may be located on the window side of the door frame between corner B and C.

The hemming units 35A–C all function in the same manner and only the shape of each unit differs. The shape of hemming units 35A–C is dependent on the side of the door to be hemmed. As a result, this description will discuss only hemming unit 35A located along the hinge side of the door. Only this hemming unit is shown in FIG. 1. The other two hemming units are similar to the one discussed in this preferred embodiment.

A first die holder 40 and a second die holder 41 are bolted onto a casting frame 38. A pre-hem die block 42 is bolted onto first die holder 40. The pre-hem die block 42 has a bevelled edge that will force flange 16 to be bent by approximately 45° with respect to the general plane of panel 14. A final hem die block 44 is bolted onto second die holder 41. The final hem die block 44 has a substantially right angled edge that is used for the final bending of flange 16 over edge portion 12.

Figure 3:
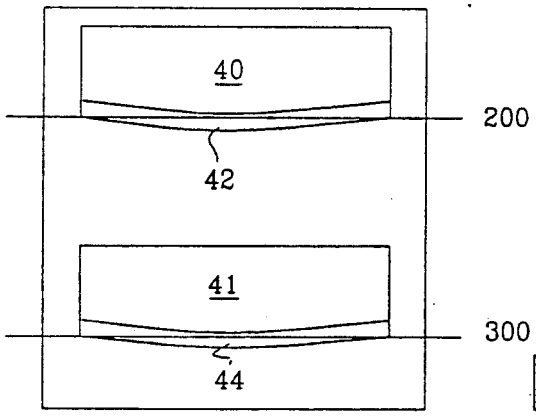
FIGS. 3 and 4 are front and side elevational views of the die blocks that can be used in the embodiment illustrated in FIGS. 1 and 2.
Figure 4:
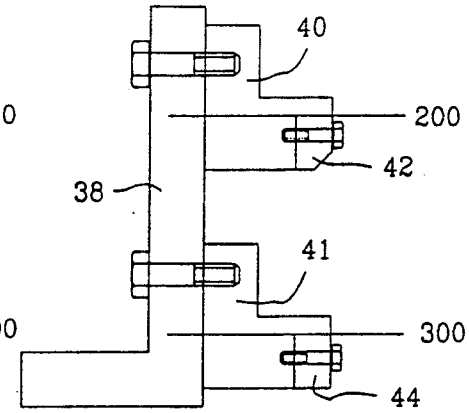

Die blocks 42 and 44 are contoured along their length to conform to the shape of the peripheral edge of the door, as shown in FIG. 3. A casting cylinder 36 is used to move casting frame 38 into position for the various stages of the hemming process.

The corner pre-hem unit 49 is positioned above hemming unit 35A. Corner unit 49 is comprised of a corner pre-hem die block 50 and a corner cylinder 52. The corner block 50 is used to pre-hem corner A of panels 10 and 14. Pre-hemming the corner of the panels is not necessary, however, a pre-hemmed corner greatly increases the dimensional consistency in the hemmed door and eliminates the problem of crimping occurring at corner A when the two coincident edges are subsequently fully hemmed.

Corner B does not require pre-hemming because the corner is rounded with flange 16 decreasing in its upturned height. Corners B and C do not require pre-hemming because the edge between corners B and C is not being hemmed in this embodiment.

The corner clamp unit 59 is constructed to be integrated with corner unit 49 wherein a contact block 62 is positioned above corner die block 50. A clamp cylinder 60 is used to move contact block 62 against panels 10 and 14 to hold them together during the corner pre-hem procedure.

Corner clamp unit 59 and corner pre-hem unit 49 are shown in FIG. 1 in an elevated position to show detail of the component parts.

The control unit (e.g. a computer), which is not shown in the drawings, is used to synchronize the operation of the various cylinders throughout the hemming procedure.

The method of joining two steel panels together using the hemming machine of this invention will be described in conjunction with FIG. 1.

Panels 10 and 14 are prepared for hemming by placing them in their cooperating relative position. Specifically, edge portion 12 of panel 10 is placed close to the base of securing flange 16 of outer panel 14. The transfer cylinder 22 elevates transfer cradle 24 to transfer position 100. The nested panels 10 and 14 are placed on transfer cradle 24 by either manual or some automated means.

Lift cylinders 28 raise support nest 26 and base 29 to pre-hem position 200. Transfer cylinder 22 lowers the nested panels 10 and 14 until they are placed on support nest 26. Transfer cylinder 22 then continues to lower transfer cradle 24 to a position below final hem position 300.

Press cylinders 30 raise support nest 26, which are supporting the nested panels 10 and 14, by approximately 2.5 cm. Support base 29 remains in a fixed position when press cylinders 30 raise nest 26. Corner clamp unit 59 clamps panels 10 and 14 together to reduce shifting of panels 10 and 14 during the corner pre-hem procedure. The clamp cylinder 60 is used to engage contact block 62 to the surface of inner panel 10. The nested panels 10 and 14 are then clinched between contact block 62 and support nest 26.

The corner cylinder 52 advances the corner pre-hem die block 50 to corner A where two flanged sides meet. The securing flanges 16 are bent to an approximate angle of 45° with respect to the general plane of outer panel 14 in an interleaving relation. This overlap of flanges 16 is accomplished by bending flange 16 of one side first then folding flange 16 of the coincident edge. This is accomplished using block 50 that is offset from the corner line of corner A as shown in FIG. 2.

The contact block 62 is then disengaged to release the clamping force on the nesting panels 10 and 14. Cylinder 52 then retracts corner pre-hem unit 49 into its previous resting position. Press cylinders 30 lower support nest 26, which support panels 10 and 14 with corner A pre-hemmed.

The casting cylinder 36 advances casting frame 38 forward to a position above the edge of securing flange 16 of outer panel 14. Press cylinders 30 raise support nest 26 approximately 2.5 cm. This movement will cause securing flange 16 to press against stationary pre-hem die block 42 and bend flange 16 approximately 45° with respect to the general plane of panel 14. All three hemming units 35A–C operate simultaneously to pre-hem all three edges of panels 10 and 14. A cross-sectional view of the pre-hemmed panels 10 and 14 is shown at pre-hem position 200 of FIG. 1.

Press cylinders 30 lower support nest 26 by approximately 2.5 cm. Casting cylinder 36 retracts casting frame 38 into its previous resting position. Lift cylinders 28 lower support nest 26 and base 29, which support pre-hemmed panels 10 and 14, to final hem position 300.

The casting cylinder 36 advances casting frame 38 forward to a position above the edge of the pre-hemmed flange 16 of outer panel 14. Press cylinders 30 raise support nest 26 approximately 2.5 cm. This movement will cause securing flange 16 to press against stationary final hem die block 44 bending securing flange 16 of outer panel 14 into firm contact with edge portion 12 of inner panel 10. All three hemming units 35A–C operate simultaneously to final hem all three edges of panels 10 and 14. A cross-sectional view of the hemmed panels 10 and 14 is shown at final hem position 300 of FIG. 1.

Press cylinders 30 lower support nest 26 by approximately 2.5 cm. Casting cylinder 36 retracts casting frame 38 into its previous resting position. Lift cylinders 28 raise support nest 26 and base 29, which support hemmed panels 10 and 14, to pre-hem position 200. The hemmed panels 10 and 14 are then lifted out of support nest 26 by panel lifting system 23 to transfer position 100. The hemmed panels 10 and 14 can then be removed either by manual or automated means.

It has been found that moving the workpieces relative to stationary die units greatly improves the contact of the flange with the edge portion and reduces the occurrence of shifting of the inner panel relative to the outer panel. In addition, by using two independent die sets the edge of the flange can be bent cleanly over the edge of the other panel with very little roll.

I claim:

1. A machine for forming a unitary structure from a first steel panel having an upturned flange and a second steel panel having a flat edge portion, comprising:

(a) a support surface unit including a support surface for receiving said first panel and said second panel in a superimposed relation with said edge portion of said second panel proximate to said flange of said first panel;

(b) a plurality of first flange engaging members having bevelled engaging surfaces, said first flange engaging members being located at a pre-hem position;

(c) a plurality of second flange engaging members having substantially right-angled engaging surfaces, said second flange engaging members being located at a final-hem position;

(d) means for moving said support surface unit to said pre-hem position such that said flange of said first panel is pressed against said bevelled engaging surfaces of said first flange engaging members, wherein said flange of said first panel is bent by approximately 45° with respect to the plane of said first panel to form a pre-hemmed flange;

(e) means for moving said support surface to said final hem position such that said pre-hemmed flange is pressed against said substantially right-angled engaging surfaces of said second flange engaging members, wherein said pre-hemmed flange of said first panel is bent to fully clinch said edge portion of said second panel to form said unitary structure.

2. The machine of claim 1, further including means for bending said flange at a corner where two coincident flanged sides meet, comprising:

(a) means for clamping said first and said second panel together;

(b) a corner flange engaging member having an offset substantially triangular engaging surface, wherein said corner flange engaging member bends said coincident flanges at said corner in an interleaving relation.

3. The machine of claim 2, further including a means for moving said corner flange engaging member against said corner where two coincident flanged sides meet.

4. The machine of claim 3, wherein said means for moving said flange engaging member is a pneumatic cylinder.

5. The machine of claim 1, further including a transfer lift means for raising and lowering said first and second panels to be received by said support surface unit.

6. The machine of claim 5, wherein said transfer lift means comprises:

(a) a fluid actuated cylinder; and (b) a support means connected to the top of said fluid actuated cylinder, said support means being used to support said first and second panels.

7. The machine of claim 1, wherein said support surface unit comprises:

(a) a support base; and (b) a support nest having an upper surface, which is said support surface, said support nest being movably connected to said support base and said support nest being located above said support base.

8. The machine of claim 7, wherein said upper surface of said support nest is shaped to conform to the shape of said first panel.

9. The machine of claim 7, wherein said support nest is moved relative to said support base by a plurality of fluid actuated press cylinders, said press cylinders being located between said support base and said support nest.

10. The machine of claim 7, wherein said support surface unit is moved by a plurality of fluid actuated lift cylinders, said lift cylinders being connected between said support base and a frame.

11. The machine of claim 1, wherein each first flange engaging member of said plurality of first flange engaging members and each second flange engaging member of said second flange engaging members are integrally connected to a plurality of brace means, each of said first flange engaging members being disposed above each of said second flange engaging members in a one-to-one relation.

12. The machine of claim 11, further including a plurality of fluid actuated cylinders for moving said plurality of brace means laterally, wherein said first and second flange engaging members are placed in said pre-hem and said final hem positions, respectively.

13. A method for forming a unitary structure from a first steel panel with an upturned flange and a second steel panel with a flat edge portion, comprising:

(a) placing said second panel in a superimposed relation to said first panel on a support surface, said edge portion of said second panel being proximate to said flange of said first panel;

(b) clamping said first and said second panel together;

(c) bending said flange of said first panel at at least one corner, where two coincident flanged sides meet, in an interleaving relation;

(d) pressing said flange of said first panel against a plurality of first flange engaging members so that said flange is bent to approximately 45° with respect to the plane of said first panel to produce a pre-hemmed flange;

(e) pressing said pre-hemmed flange of said first panel against a plurality of second flange engaging members so that said flange is fully engaged against said edge portion of said second panel to form said unitary structure.

* * * * *